US005552669A

United States Patent [19]

Ikedo et al.

[11] Patent Number: 5,552,669

[45] Date of Patent: Sep. 3, 1996

[54] DEUTERIUM GAS DISCHARGE TUBE

[75] Inventors: Tomoyuki Ikedo; Yoshinobu Ito; Ryotaro Matui, all of Hamamatsu, Japan

[73] Assignee: Hamamatsu Photonics K.K., Japan

[21] Appl. No.: 305,972

[22] Filed: Sep. 15, 1994

[30] Foreign Application Priority Data

May 31, 1994 [JP] Japan ..... 6-118638

[51] Int. Cl.[6] ..... H01J 17/02

[52] U.S. Cl. ..... 313/613; 313/589; 313/292

[58] Field of Search ..... 313/613, 614, 313/590, 589, 292, 243, 112

[56] References Cited

U.S. PATENT DOCUMENTS

| | | | |
|---|---|---|---|
| 4,611,143 | 9/1986 | Shimazu et al. . | |
| 4,910,431 | 3/1990 | Witt et al. | 313/589 |
| 5,057,742 | 10/1991 | Kawai et al. | 313/292 |
| 5,191,260 | 3/1993 | Kawai et al. | 313/613 |

FOREIGN PATENT DOCUMENTS

| | | |
|---|---|---|
| 3908553 | 4/1990 | Germany . |
| 4-255662 | 9/1992 | Japan . |
| 5-217550 | 8/1993 | Japan . |
| 1086482 | 4/1984 | U.S.S.R. . |
| 1140189 | 2/1985 | U.S.S.R. . |

*Primary Examiner*—Sandra L. O'Shea
*Assistant Examiner*—Matthew J. Esserman
*Attorney, Agent, or Firm*—Cushman Darby & Cushman, LLP

[57] ABSTRACT

A gas discharge tube of the present invention has an envelope for accommodating an anode for receiving thermoelectrons emitted from a thermionic cathode, a focusing electrode for focusing a path of the thermoelectrons from the thermionic cathode to the anode, and a discharge shielding plate consisting of a material having electrical insulating properties, the anode being arranged in contact with one side of the discharge plate, and the focusing electrode being arranged in contact with the other side of the discharge shielding plate. Since the anode and the focusing electrode are arranged in contact with both the sides of the discharge shielding plate consisting of an insulating material such as a ceramic, the positions of these electrodes are held at high accuracy, and the electrical insulating properties therebetween are maintained even at a high temperature during long-time continuous light emission. For this reason, a short circuit between the electrodes and variations in length of a discharge path can be prevented. Therefore, a gas discharge tube having a long service life and a high operational stability during long-time continuous light emission can be provided.

24 Claims, 9 Drawing Sheets

DEUTERIUM GAS DISCHARGE TUBE

BACKGROUND OF THE INVENTION

1. Field of the Invention

The present invention relates to a gas discharge tube used as an ultraviolet light source for a spectrophotometer, liquid chromatography, or the like.

2. Related Background Art

A gas discharge tube is a discharge light source using a positive column light emission by arc discharge of a gas filled in a tube. As a typical gas discharge tube, a deuterium discharge tube in which ultraviolet light is emitted by discharge of filled deuterium is well known. This deuterium discharge tube is mainly used as an ultraviolet continuous spectrum source used for a spectrophotometer or the like. In this discharge tube, very small variations, i.e., variations of 0.01% or 0.001%, in output pose a problem during long-time continuous lighting. For this reason, strict characteristics are required in many cases.

In a conventional side-on type deuterium discharge tube which extracts light from the side portion of the tube, a glass envelope incorporates a light-emitting portion for extracting light in accordance with arc discharge. Deuterium gas is filled in the envelope at about several Torr. The light-emitting portion is constituted in a metal discharge shielding box, mounted on a stem, and connected to an external power supply through a lead line.

In the light-emitting portion, a thermionic cathode for emitting thermoelectrons, an anode for receiving the thermoelectrons, and a focusing electrode for focusing arc discharge which occurs between the thermionic cathode and the anode are accommodated in the metal discharge shielding box in a state (floating state) wherein they are not in contact with constituent elements except for the lead line.

The operation will be described below. A power of about 10 W is applied to the thermionic cathode for 10 to 60 seconds before discharge to preheat the thermionic cathode. When the thermionic cathode is sufficiently heated and ready for arc discharge, a trigger voltage of 350 to 500 V is applied between the anode and the thermionic cathode, thereby starting arc discharge. At this time, the path of thermoelectrons is limited to only one because of convergence by the focusing electrode and the shielding effect of the discharge shielding box. More specifically, the thermoelectrons emitted from the thermionic cathode pass along the path converged by the focusing electrode and are received by the anode. An arc ball is generated by arc discharge in a space in front of the focusing electrode on the opposite side to the anode. Light extracted from positive column light emission caused by this arc discharge is projected toward the front side of the anode.

Not to interrupt this optical path, the thermionic cathode is arranged in the discharge shielding box at the side portion along the light projecting direction. After discharge is started, the entire deuterium discharge tube generates heat due to the arc discharge, and the thermionic cathode also receives this heat. Therefore, to prevent overheat of the thermionic cathode, the power applied to the thermionic cathode after discharge is decreased to 1 to 2 W. The heat value due to discharge is very large, so there is a water-cooled type deuterium discharge tube which cools the entire discharge tube by cooling water.

Independent of this prior art, a gas discharge tube having a ceramic discharge vessel commonly used as an envelope is known. In this deuterium discharge tube, ultraviolet light is extracted from an anode side. A thermionic cathode, an anode, and a focusing electrode are accommodated in a ceramic discharge shielding box in a state (floating state) wherein they are not in contact with constituent elements except for a lead line. Such a deuterium discharge tube is described in detail in, e.g., Japanese Patent Laid-Open No. 4-255662.

SUMMARY OF THE INVENTION

In the above conventional gas discharge tubes, the anode and the focusing electrode are accommodated in the discharge shielding box in the floating state. The insulating state between the two electrodes is maintained by forming a space therebetween. During long-time light emission, the anode receives thermoelectrons to generate heat while heat generated during light emission is concentrated on the focusing electrode. For this reason, the anode and the focusing electrode themselves are heated on a very high temperature. The temperature of the anode and the focusing electrode at this time may exceed 1,000° C., and the electrode itself may be deformed due to a residual stress. When the anode and the focusing electrode, both of which are arranged in the floating state, are deformed at a high temperature, the path of the thermoelectrons between the focusing electrode and the anode is deformed accordingly. Since this makes the arc discharge state unstable, the stability of light emission of the discharge tube is impaired, and the service life of the discharge tube is shortened.

It is an object of the present invention to provide a gas discharge tube having a long service life, which improves the operational stability of long-time continuous light emission.

In order to achieve the above object, according to the present invention, there is provided a first gas discharge tube comprising an envelope for accommodating an anode for receiving thermoelectrons emitted from a thermionic cathode, a focusing electrode for focusing a path of the thermoelectrons from the thermionic cathode to the anode, and a discharge shielding plate consisting of a material having electrical insulating properties, the anode being arranged in contact with one side of the discharge shielding plate, and the focusing electrode being arranged in contact with the other side opposing the one side of the discharge shielding plate.

In order to achieve the above object, according to the present invention, there is provided a second gas discharge tube comprising an envelope for accommodating a thermionic cathode for emitting thermoelectrons, an anode for receiving the thermoelectrons emitted from the thermionic cathode, a focusing electrode having a focusing opening for focusing a path of the thermoelectrons emitted from the thermionic cathode and moving toward the anode, and a discharge shielding plate having a through-hole with a larger inner diameter than that of the focusing opening and consisting of a material having electrical insulating properties, the anode being arranged in contact with one opening end of the through hole, and the focusing electrode being arranged in contact with the other opening end of the through-hole.

In the envelope, a support plate consisting of the material having electrical insulating properties may be arranged on an opposite side to the discharge shielding plate to have the anode therebetween. Especially, the discharge shielding plate and the support plate are preferably formed of a ceramic.

A notch having a direction of depth substantially perpendicular to an extending direction of the through-hole may be formed in an inner wall of the through-hole of the discharge shielding plate around the extending direction of the through-hole.

In the gas discharge tube of the present invention, the anode and the focusing electrode are arranged in contact with both the sides of the discharge shielding plate consisting of an insulating material such as a ceramic. For this reason, the positions of the two electrodes are held at high accuracy, and the electrical insulating properties between the two electrodes are maintained even at a high temperature during long-time continuous light emission. Therefore, a short circuit between the electrodes and variations in length of a discharge path can be prevented.

In addition, when the anode is sandwiched between the discharge shielding plate and the support plate, shielding box structure constituted by the discharge plate and the support plate can be formed of only the insulating material.

Furthermore, when a notch iS formed in the inner wall of the through-hole to be perpendicular to the extending direction, an electrode material which is sputtered from the anode and the focusing electrode by thermoelectrons during light emission of the gas discharge tube is hardly deposited in the notch, so a short circuit between the focusing electrode and the anode can be prevented.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
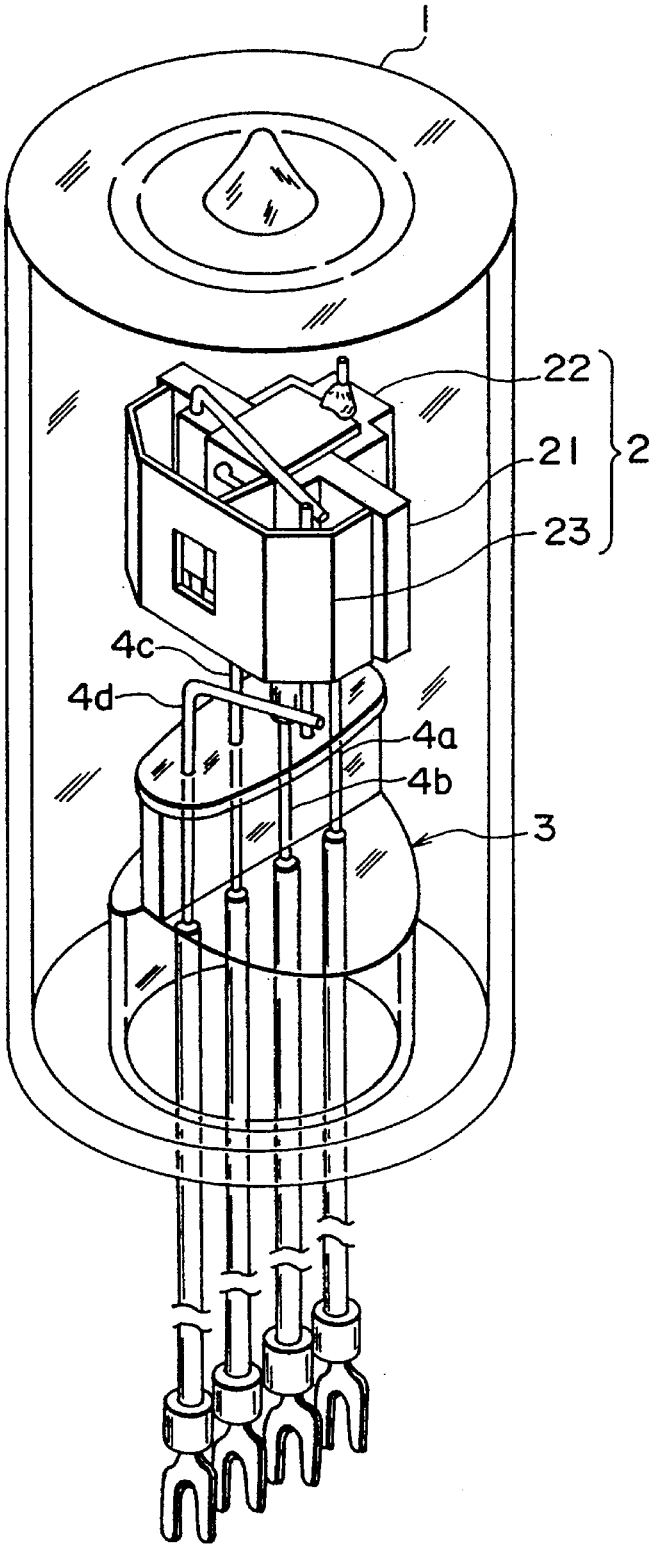
FIG. 1 is a perspective view showing the entire arrangement of a deuterium discharge tube according to the first embodiment of the present invention.

The arrangements and functions of embodiments of the present invention will be described below with reference to FIGS. 1 to 10. The same reference numerals denote the same elements throughout the drawings, and a detailed description thereof will be omitted.

First Embodiment

Figure 2:
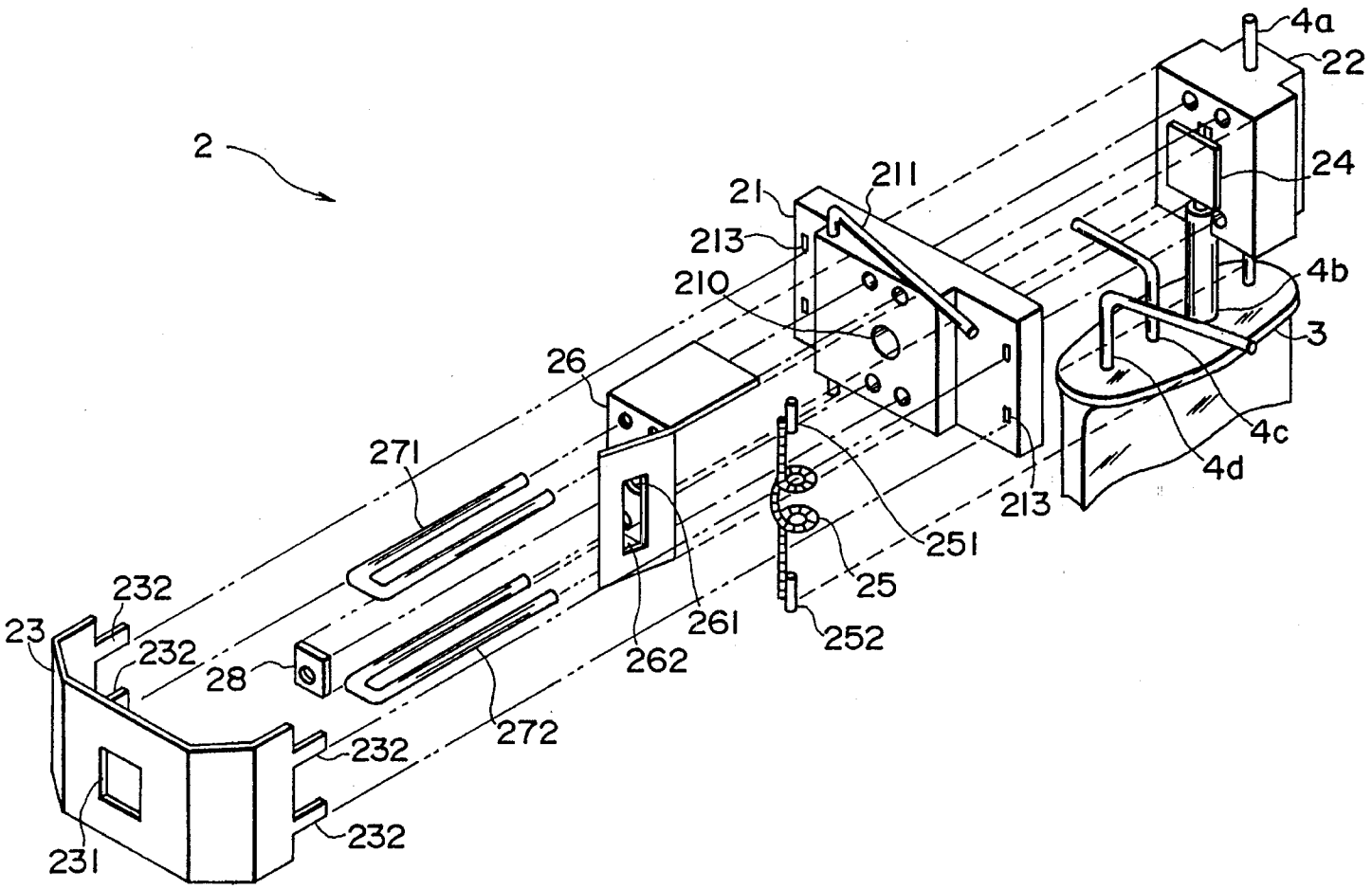
FIG. 2 is a perspective view showing the arrangement of a light-emitting portion assembly of the deuterium discharge tube in FIG. 1 in a disassembled state.
Figure 3:
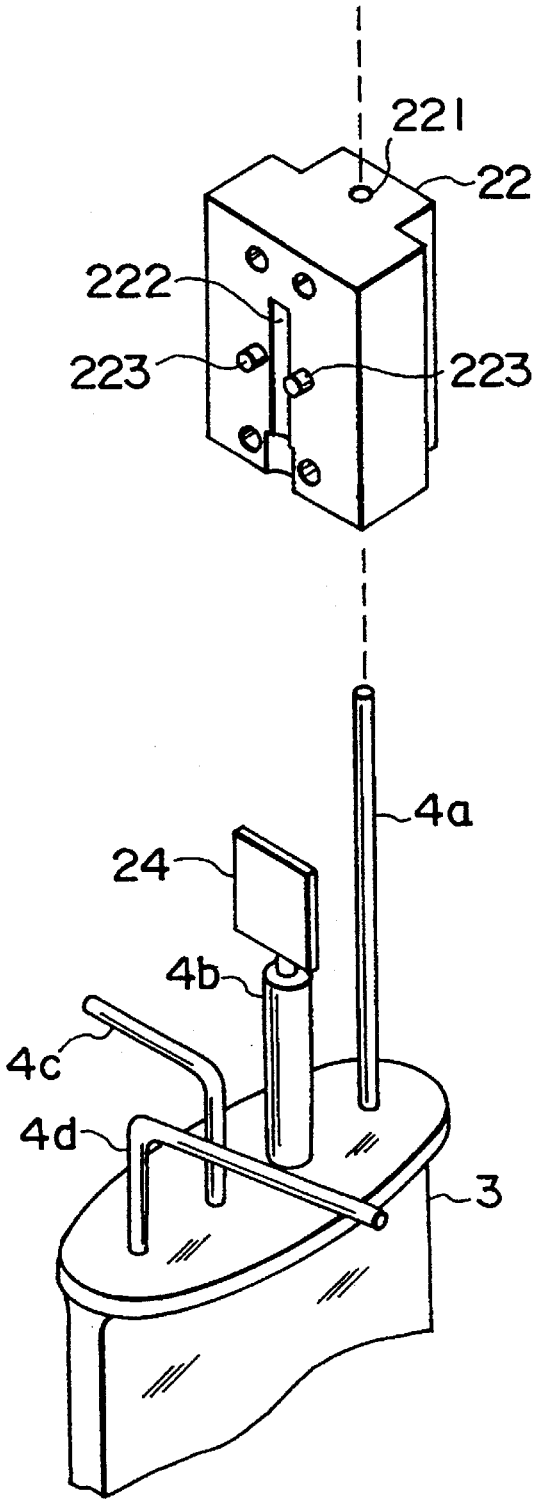
FIG. 3 is a perspective view showing the arrangement of an anode and a support plate of the light-emitting portion assembly in FIG. 2 in the disassembled state.
Figure 4:
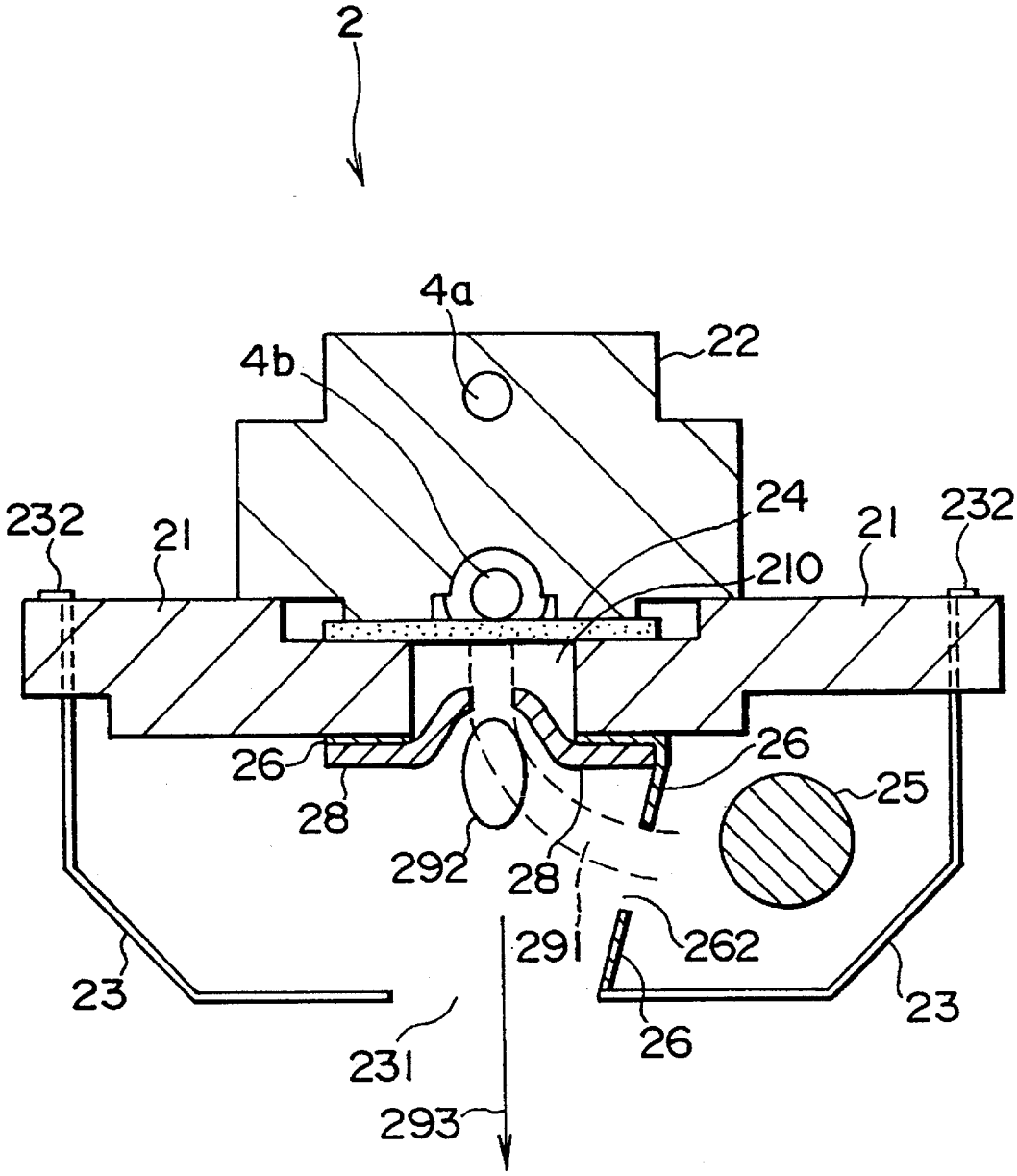
FIG. 4 is a cross-sectional view showing the arrangement of the light-emitting portion assembly of the deuterium discharge tube in FIG. 1.

A gas discharge tube of this embodiment is a side-on type deuterium discharge tube which extracts light from a side portion of the tube. FIG. 1 is a perspective view showing the entire arrangement of the deuterium discharge tube of this embodiment. FIG. 2 is a perspective view showing the arrangement of a light-emitting portion assembly of the deuterium discharge tube in FIG. 1 in a disassembled state. FIG. 3 is a perspective view showing the arrangement of an anode and a support plate of the light-emitting portion assembly in FIG. 2 in the disassembled state. FIG. 4 is a cross-sectional view showing the arrangement of the light-emitting portion assembly of the deuterium discharge tube in FIG. 1. This embodiment is characterized only in that the arrangement of a light-emitting portion assembly 2 is different from that of the prior art As shown in FIG. 1, the light-emitting portion assembly 2 is accommodated in a glass envelope 1. Deuterium gas (not shown) is filled in the envelope 1 at about several Torr. The bottom portion of the envelope 1 is hermetically sealed by a glass stem 3. Four lead pins 4*a* to 4*d* extend through the stem 3 from the lower portion of the light-emitting portion assembly 2 to be externally exposed. The light-emitting portion assembly 2 has a shielding box structure constituted by bonding a discharge shielding plate 21 and a support plate 22, both of which consist of aluminum as ceramic, and a metal front cover 23 mounted in front of the discharge shielding plate 21. The arrangement of the light-emitting portion assembly 2 will be described below in detail with reference to FIGS. 2 to 4.

As shown in FIGS. 2 and 3, the support plate 22 has a convex section, and a through-hole 221 is vertically formed in the support plate 22 at its rear portion. The lead pin 4*a* is inserted in the through-hole 221 and held by the stem 3. A groove 222 having a concave section is formed in the front surface of the support plate 22 and vertically extends downward. The lead pin 4*b* extending from the stem 3 is buried in the groove 222, thereby fixing the support plate 22 to the stem 3. A rectangular plate-like anode 24 facing forward is fixed to the lead pin 4*b* and held in contact with two projecting portions 223 formed on the front surface of the support plate 22.

As shown in FIG. 2, the discharge shielding plate 21 has a convex section thinner and wider than the support plate 22. A through-hole 210 is formed in the discharge shielding plate 21 at a position corresponding to the anode 24 at the central portion. A through-hole is vertically formed in the projecting portion of the discharge shielding plate 21 at its side portion. An electrode rod 211 bent into an L-shape is inserted in this through-hole. In a state wherein the discharge shielding plate 21 is bonded to the support plate 22, the lower end of the electrode rod 211 is welded to the distal end of the lead pin 4c bent into an L-shape. An upper electrode rod 251 of a thermionic cathode 25 is welded to the sideward-extending distal end of the electrode rod 211. In the state wherein the discharge shielding plate 21 is bonded to the support plate 22, a lower electrode rod 252 is welded to the distal end of the lead pin 4d bent into an L-shape.

As shown in FIG. 2, a metal focusing electrode 26 is constituted by an L-shaped metal plate. A focusing opening 261 is formed in the metal plate at its intermediate portion coaxially with the through-hole 210 of the discharge shielding plate 21, and the metal plate is bent backward at its upper portion and forward at its side portion in a direction of the thermionic cathode 25. A vertically elongated rectangular opening 262 is formed in the metal plate at its side portion to face the thermionic cathode 25. Four through-holes are formed in each of the discharge shielding plate 21, the support plate 22, and the focusing electrode 26 at positions corresponding to each other. Therefore, in the state wherein the discharge shielding plate 21, the support plate 22, and the focusing electrode 26 are bonded to each other, when two metal pins 271 and 272, both of which are bent into a U-shape, are inserted to these through-holes, these elements are fixed to the stem 3.

As shown in FIGS. 1 and 2, the metal front cover 23 has a U-shaped section bent at four portions. A window 231 for projecting light is formed in the front cover 23 at its central portion. Two projecting portions 232 are formed at each of the two ends of the front cover 23 and arranged in correspondence with four through-holes 213 formed in the discharge shielding plate 21 at its front end portions. These projecting portions 232 are inserted in the through-holes 213 to fix the front cover 23 to the discharge shielding plate 21. In this state, the front end portion of the focusing electrode 26 is in contact with the inner surface of the front cover 23, thereby separating a space where the thermionic cathode 25 is arranged from the light-emitting space.

As shown in FIGS. 2 and 4, the focusing electrode 26 of this embodiment has, at its central portion, the focusing opening 261 coaxially formed with the through-hole 210 of the discharge shielding plate 21. An opening limit plate 28 for limiting the opening diameter is fixed at the focusing opening 261 by welding. The opening limit plate 28 is bent around the focusing opening toward the anode 24. Therefore, the distance between the anode 24 and the opening of the opening limit plate 28 is smaller than the thickness of the discharge shielding plate 21.

FIG. 4 shows the arrangement of the electrodes in the light-emitting portion assembly 2 having the above arrangement. The anode 24 is fixed between the discharge shielding plate 21 and the support plate 22. The opening limit plate 28 welded to the focusing electrode 26 is fixed to the discharge shielding plate 21 at a position opposing the anode 24 through the through-hole 210 of the discharge shielding plate 21. The thermionic cathode 25 is arranged in a space surrounded by the discharge shielding plate 21, the front cover 23, and the surface of the focusing electrode 26, which has the rectangular opening 262, at a position to face the opening limit plate 28 through the rectangular opening 262.

The operation of the deuterium discharge tube of this embodiment will be described below with reference to FIG. 4.

A power of about 10 W is applied to the thermionic cathode 25 for 10 to 60 seconds before discharge, so that the thermionic cathode 25 is preheated. When the thermionic cathode 25 is sufficiently heated to be ready for arc discharge, a trigger voltage of 350 to 500 V is applied between the anode 24 and the cathode 25, thereby starting discharge. At this time, the path of thermoelectrons is limited to only a path 291 (indicated by a portion between broken lines ) because of convergence by the opening limit plate 28 of the focusing electrode 26 and the shielding effect of the discharge shielding plate 21 and the support plate 22. More specifically, the thermoelectrons (not shown) emitted from the thermionic cathode 25 pass through the opening limit plate 28 from the rectangular opening 262 of the focusing electrode 26 and through the through-hole 210 of the discharge shielding plate 21 and are received by the anode 24. An arc ball 292 is generated by the arc discharge in a space in front of the opening limit plate 28 on the opposite side to the anode 24. Light extracted from the arc ball 292 is projected in a direction substantially indicated by an arrow 293, i.e., toward the front side of the anode 24 through the opening window 231 of the front cover 23.

As described above, in the light-emitting portion 2 of the deuterium discharge tube of this embodiment, the anode 24 is fixed between the discharge shielding plate 21 and the support plate 22, both of which consist of a ceramic, and the focusing electrode 26 having the opening limit plate 28 is fixed to the discharge shielding plate 21. With this arrangement, the positions of the two electrodes can be held at high accuracy even at a high temperature during long-time continuous light emission. Therefore, the deuterium discharge tube of this embodiment realizes a continuously stable operation for a long time.

As a material for constituting the discharge shielding plate 21 and the support plate 22, a so-called conductive ceramic such as beryllium oxide or aluminum nitride having a high thermal conductivity can also be used. In this case, the discharge shielding plate 21 and the support plate 22 serve as a heat sink for the anode 24 which is heated to a high temperature due to self heat generation and promote dissipation of the heat accumulated in the light-emitting portion assembly 2. Therefore, the operational stability of the deuterium discharge tube can be further improved.

Second Embodiment

Figure 5:
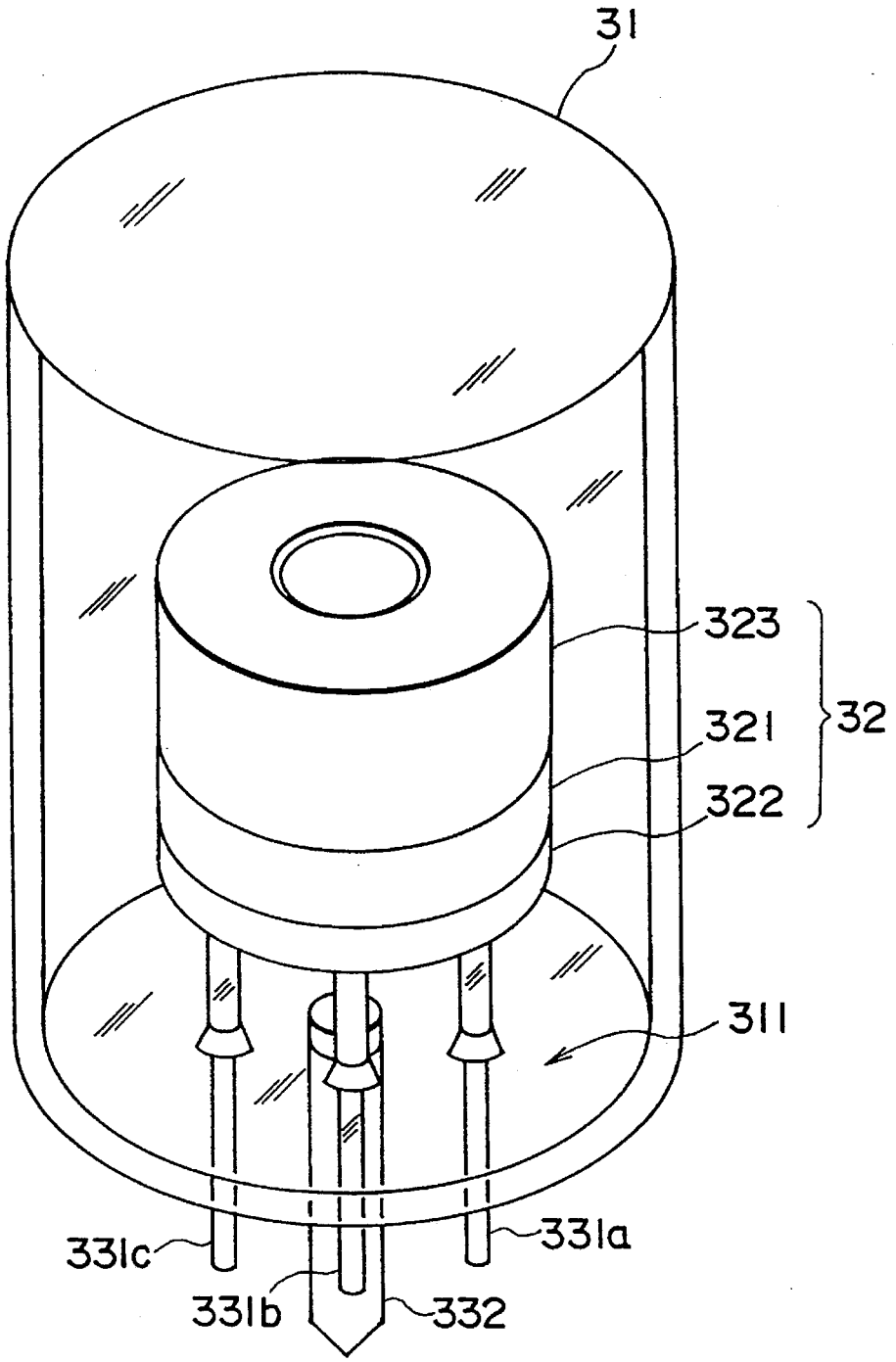
FIG. 5 is a perspective view showing the entire arrangement of a deuterium discharge tube according to the second embodiment of the present invention.
Figure 6:
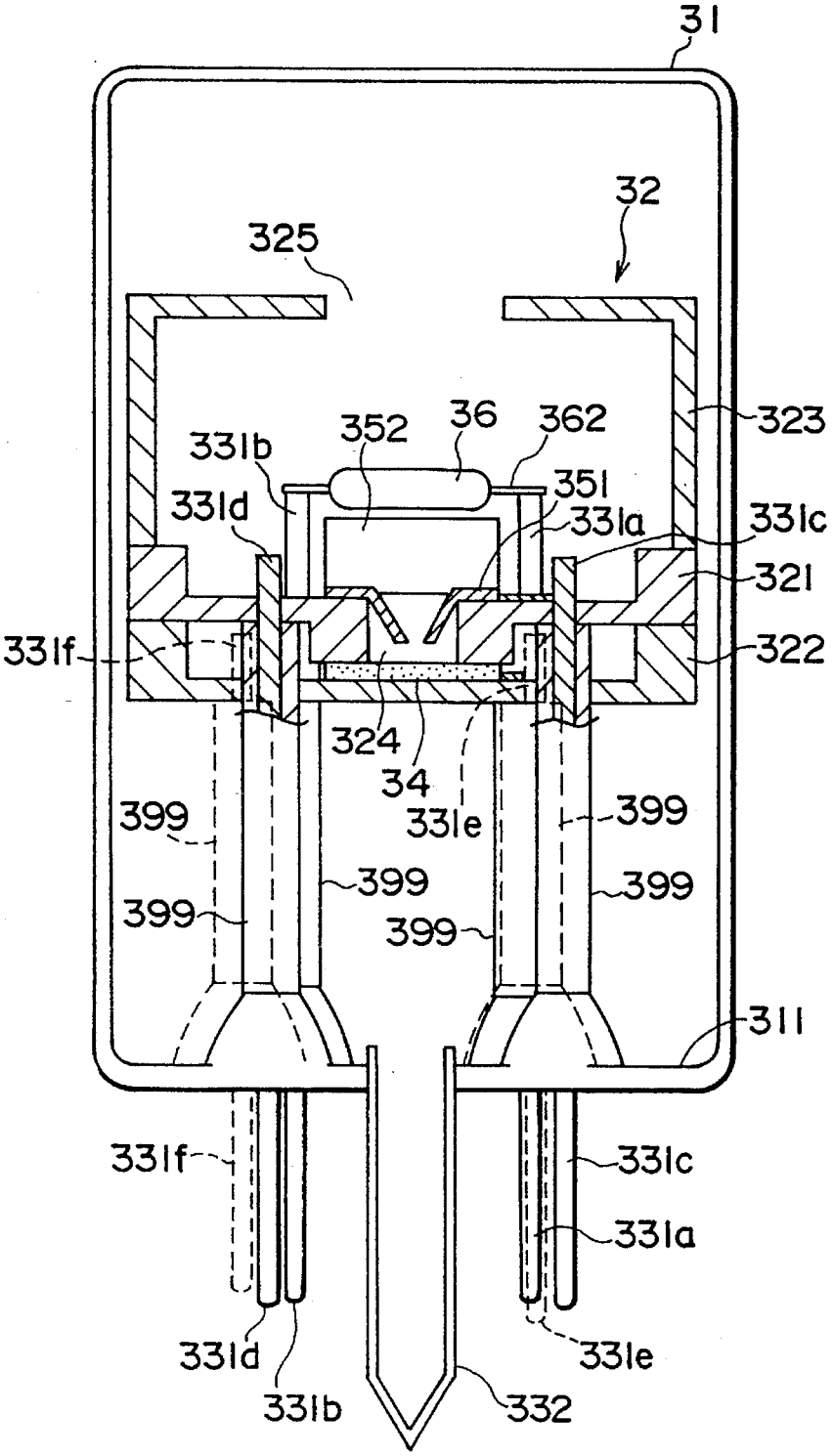
FIG. 6 s a longitudinal sectional view showing the entire arrangement of the deuterium discharge tube in FIG. 5.
Figure 7:
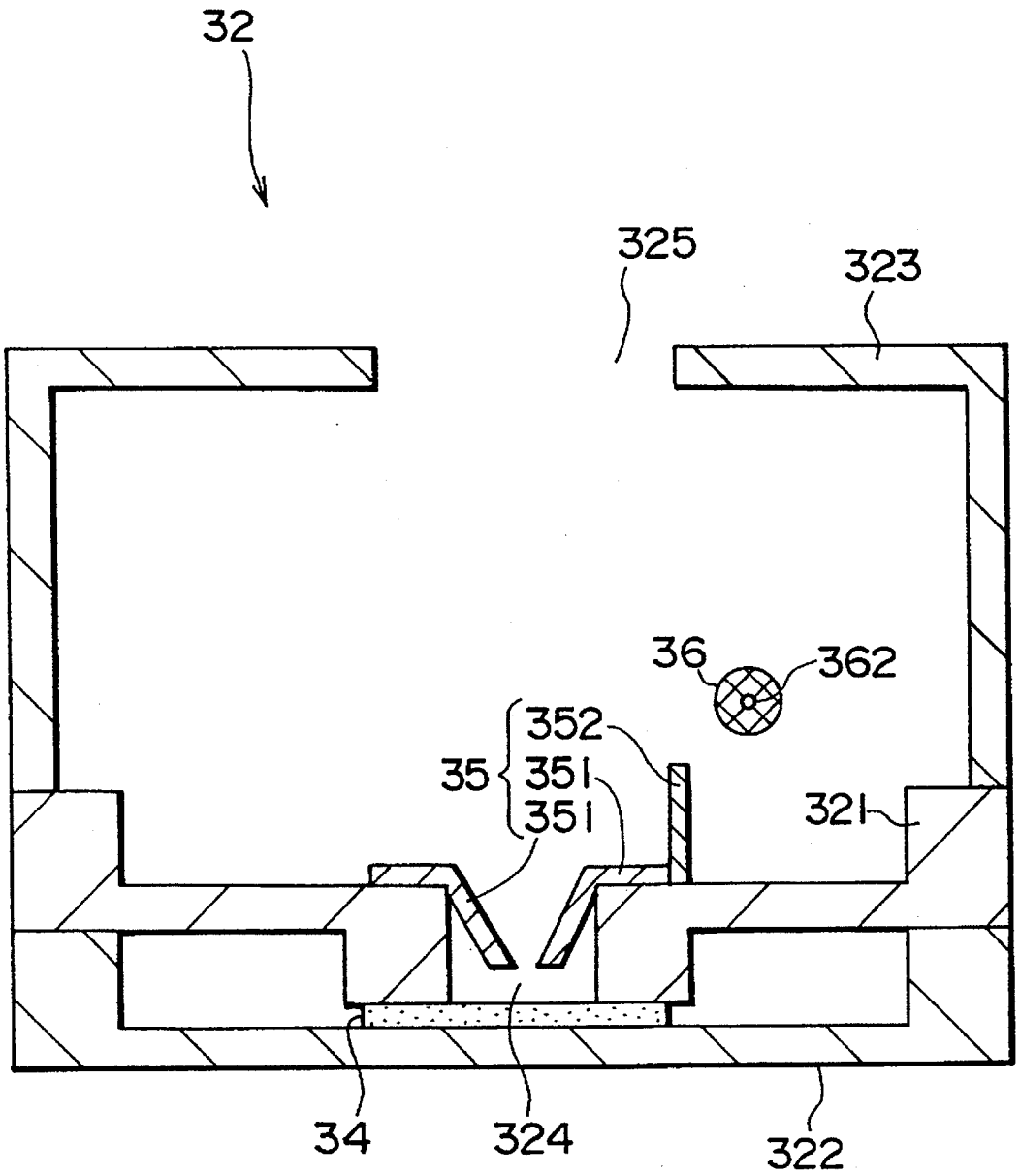
FIG. 7 is a longitudinal sectional view showing the arrangement of a light-emitting portion assembly of the deuterium discharge tube in FIG. 6.

A discharge tube of this embodiment is a head-on type deuterium discharge tube which extracts light from the head portion of the tube. FIG. 5 is a perspective view showing the entire arrangement of the deuterium discharge tube according to the second embodiment of the present invention. FIG. 6 is a longitudinal sectional view showing the entire arrangement of the deuterium discharge tube in FIG. 5. FIG. 7 is a longitudinal sectional view showing the arrangement of a light-emitting portion assembly of the deuterium discharge tube in FIG. 6. FIG. 7 shows a section which is rotated by 90° in the horizontal direction with respect to the section in FIG. 6, and lead pins and the like are not illustrated. This embodiment is characterized only in that the arrangement of a light-emitting portion assembly 32 is different from that of the prior art.

As shown in FIGS. 5 and 6, the deuterium discharge tube of this embodiment has the light-emitting portion assembly 32 accommodated in a glass envelope 31. The light-emitting portion assembly 32 has a shielding box structure constituted by a discharge shielding plate 321 and a support plate 322, both of which consist of aluminum as ceramic, and a front cover 323. Six lead pins **331*a* to 331*f* extend through a bottom portion 311 of the envelope 31 from the lower portion of the light-emitting portion assembly 32 to be externally exposed. A tip tube 332 for exhausting/filling a gas from/in the envelope 31 is mounted on the bottom portion 311 of the envelope 31 and externally extends. The envelope 31 is sealed by the tip tube 332**.

The arrangement of the light-emitting portion assembly 32 and the arrangement of electrodes incorporated in the light-emitting portion assembly 32 will be described with reference to FIGS. 6 and 7. A flat anode 34 is arranged at almost the central portion of the inner surface of the cylindrical support plate 322 with an open upper portion, and in contact with the upper surface of the support plate 322. The discharge shielding plate 321 fixed on the support plate 322 also has a cylindrical shape with an open upper portion and the same outer diameter as that of the support plate 322. The discharge shielding plate 321 has, at its central portion, a cylindrical projecting portion projecting downward and a through-hole 324 formed at the center of this projecting portion. The discharge shielding plate 321 is coaxially fixed with the support plate 322 while the lower end portion of the through-hole 324 is in contact with the upper surface of the anode 34. The anode 34 is fixed between the discharge shielding plate 321 and the support plate 322. The front cover 323 having the same outer diameter as that of the discharge shielding plate 321 and the support plate 322 is also coaxially fixed.

As shown in FIGS. 6 and 7, a focusing electrode 35 of this embodiment has a substantially circular opening limit plate 351 having an opening with a smaller inner diameter than that of the through-hole 324, and a rectangular plate-like discharge straightening plate 352. The opening limit plate 351 and the discharge straightening plate 352 are arranged to limit the path of thermoelectrons emitted from a thermionic cathode 36 toward the anode 34 together with the shielding box structure constituted by the discharge shielding plate 321 and the support plate 322. The opening limit plate 351 is arranged at a position opposing the anode 34 through the through-hole 324 of the discharge shielding plate 321 and fixed at the periphery of the through-hole 324 of the discharge shielding plate 321. The discharge straightening plate 352 is welded to the end portion of the opening limit plate 351 to be fixed to the discharge shielding plate 321. The opening limit plate 351 is bent toward the anode 34 around the through-hole 324. Therefore, the distance between the anode 34 and the opening of the opening limit plate 351 is smaller than the length of the through-hole 324.

As shown in FIGS. 6 and 7, the thermionic cathode 36 having an electrode rod 362 is arranged above the top of the discharge straightening plate 352 on the opposite side to the opening limit plate 351 with respect to the discharge straightening plate 352. The lead pins 331*a* and 331*b* extend through the discharge shielding plate 321, and the electrode rod 362 of the thermionic cathode 36 is welded to the distal ends of the lead pins 331*a* and 331*b*, thereby fixing the thermionic cathode 36 on the discharge shielding plate 321.

Of the six lead pins 331*a* to 331*f*, the two lead pins 331*a* and 331*b* are used to apply a power to the thermionic cathode 36. The lead pin 331*c* is used to apply a bias to the opening limit plate 351, and the lead pin 331*e* is used to apply a bias to the anode 34. The six lead pins 331*a* to 331*f* extend through insulating pipes 399, respectively. By these pipes 399, the discharge shielding plate 321 and the support plate 322 are supported in the envelope 31.

In this embodiment, the path of the thermoelectrons from the thermionic cathode 36 to the anode 34 through the opening limit plate 351 is formed as in the first embodiment. The flow of the thermoelectrons, i.e., light emitted due to the arc discharge is generated above the opening limit plate 351, passes through a window 325 of the front cover 323, and is emitted to the upper surface of the envelope 31.

Third Embodiment

Figure 8:
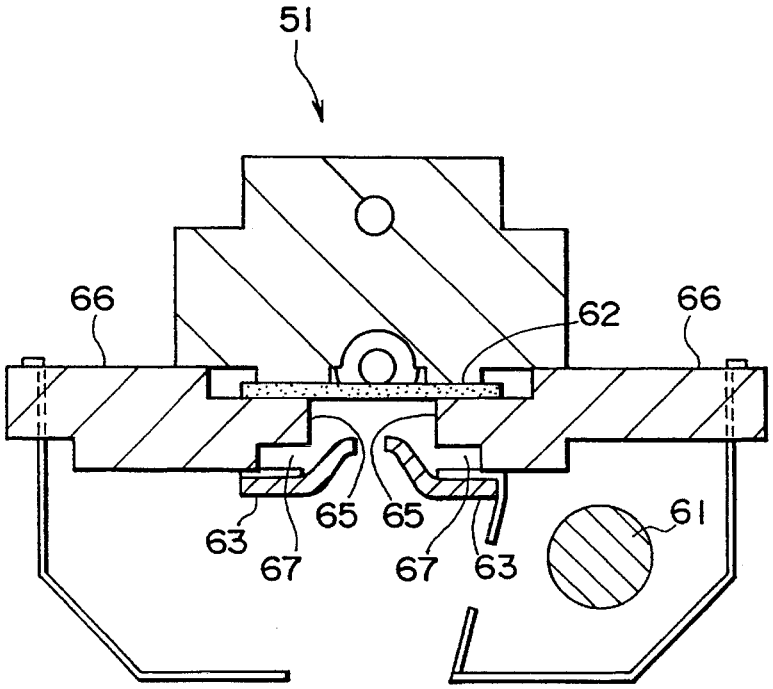
FIG. 8 is a cross-sectional view showing the arrangement of a light-emitting portion assembly of a deuterium discharge tube according to the third embodiment of the present invention.

This embodiment exemplifies a side-on type deuterium discharge tube having a discharge shielding plate with a notch (slit) formed in the inner surface of a through-hole to prevent a short circuit between an anode and a focusing electrode, which is caused due to deposition of a sputtered electrode material in the through-hole of the discharge shielding plate. FIG. 8 is a cross-sectional view showing the arrangement of a light-emitting portion assembly of the deuterium discharge tube according to the third embodiment of the present invention. The light-emitting portion assembly of the deuterium discharge tube of this embodiment has the same arrangement as that of the light-emitting portion assembly of the deuterium discharge tube shown in FIG. 4 as the first embodiment except for the presence of a slit (to be described later). Referring to FIG. 8, only elements necessary for the following description have reference numerals. The remaining elements are the same as those shown in FIG. 4, and the their reference numerals and a detailed description thereof will be omitted.

As shown in FIG. 8, thermoelectrons emitted from a thermionic cathode 61 during light emission of the discharge tube are incident on an anode 62 and an opening limit plate 63 of a focusing electrode, both of which consist of molybdenum. The sputtered molybdenum is gradually deposited on an inner surface 65 of the through-hole. As an electrode material, tungsten which is a refractory metal like the molybdenum can also be used. However, since a heat value generated during light emission is very large, the above-described sputtering cannot be prevented even when a refractory metal is used. In this embodiment, a slit 67 having a depth in a direction perpendicular to the extending direction of the through-hole is formed around the extending direction of the through-hole. An electrode material is hardly deposited in the inner wall of the slit 67. Therefore, in the deuterium discharge tube of the present invention, a short circuit between the electrodes, which is caused due to deposition of an electrode material in the through-hole of the discharge shielding plate is prevented.

Figure 9:
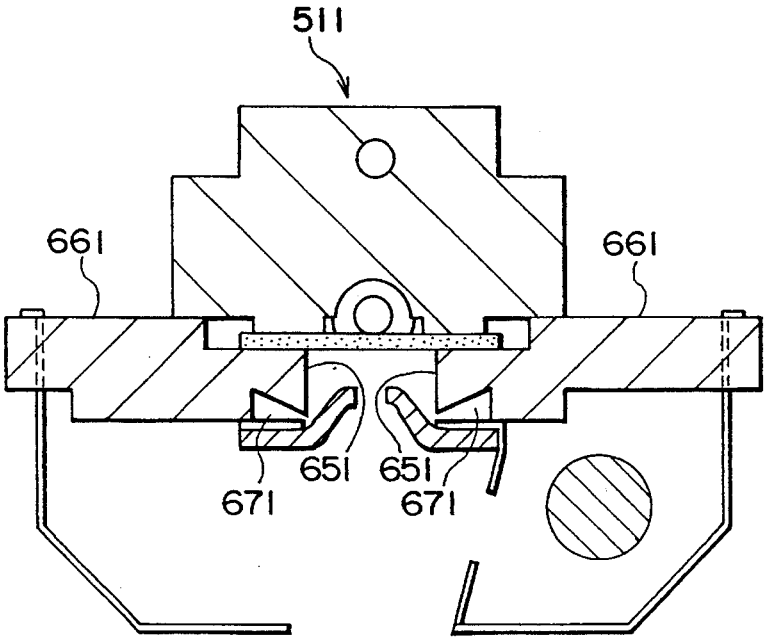
FIG. 9 is a cross-sectional view showing the arrangement of a light-emitting portion assembly as the first modification of the deuterium discharge tube in FIG. 8.
Figure 10:
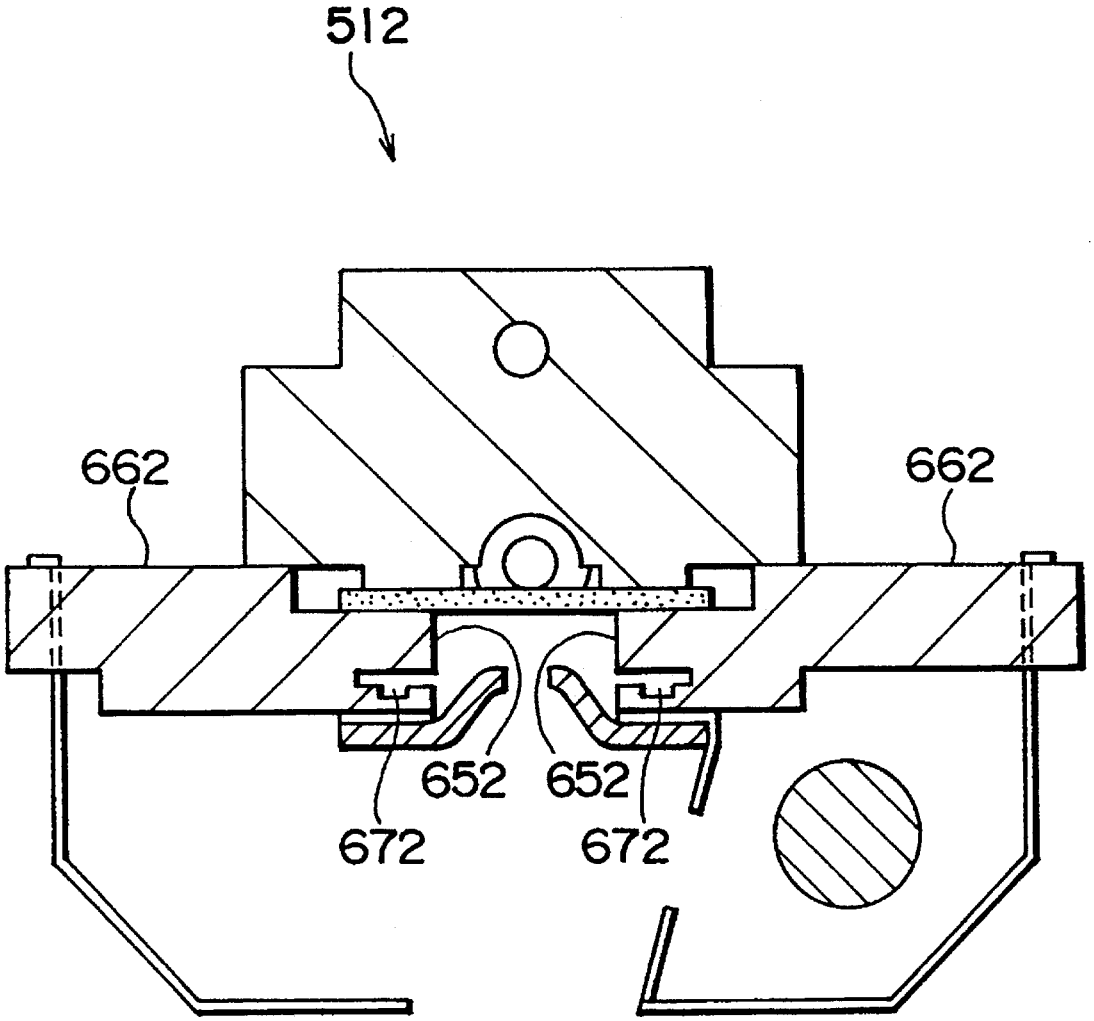
FIG. 10 is a cross-sectional view showing the arrangement of a light-emitting portion assembly as the second modification of the deuterium discharge tube in FIG. 8.

In this embodiment, by changing the shape of the slit, deposition of an electrode material in the slit can be more effectively prevented. Two modifications will be exemplified in which the shape of the section of the slit as a characteristic feature of this embodiment is changed. In these two modifications, the elements and the arrangement are the same as those of the deuterium discharge tube shown in FIG. 4 or 8 except for the shape of the slit. FIG. 9 is a cross-sectional view showing the arrangement of a light-emitting portion assembly as the first modification of the deuterium discharge tube in FIG. 8. FIG. 10 is a cross-sectional view showing the arrangement of a light-emitting portion assembly as the second modification of the deuterium discharge tube in FIG. 8. As in FIG. 8, referring to FIGS. 9 and 10, only elements necessary for the following description have reference numerals. The remaining elements are the same as those shown in FIG. 4, and a detailed description thereof will be omitted.

FIG. 9 shows the section of a light-emitting portion assembly 511 of the deuterium discharge tube as the first modification of this embodiment. As shown in FIG. 9, a slit 671 having a tapered section is formed in an inner wall 651 of the through-hole of a discharge shielding plate 661 around the extending direction of the through-hole.

FIG. 10 shows the section of a light-emitting portion assembly 512 of the deuterium discharge tube as the second modification of this embodiment. As shown in FIG. 10, a slit 672 having a section in which one more slit is formed in the slit 672 is formed in an inner wall 652 of the through-hole of a discharge shielding plate 662 around the extending direction of the through-hole.

As compared to the slit 67 of the above deuterium discharge tube having a light-emitting portion assembly 51, the slit 671 of the deuterium discharge tube having the light-emitting portion assembly 511 and the slit 672 of the deuterium discharge tube having the light-emitting portion assembly 512 are hardly coated with an electrode material. Therefore, in the modifications of this embodiment, a short circuit between the anode and the focusing electrode is more effectively prevented.

As has been described above in detail, in the gas discharge tube of the present invention, the light-emitting portion assembly has an arrangement in which the anode and the focusing electrode are arranged in contact with the two openings of the through-hole of the discharge shielding plate. For this reason, the positions of the two electrodes are held at high accuracy even at a high temperature, and the electrical insulating properties between the two electrodes are maintained. A short circuit between the two electrodes and variations in length of the discharge path at a high temperature during long-time continuous light emission can be prevented accordingly. Therefore, a gas discharge tube having a long service life and a high operational stability even during long-time continuous light emission can be provided.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A deuterium gas discharge tube comprising:

an envelope in which deuterium gas is filled;

an anode accommodated in said envelope, for receiving thermoelectrons emitted from a thermionic cathode;

a focusing electrode accommodated in said envelope, for focusing a path of the thermoelectrons from said thermionic cathode to said anode;

a discharge shielding plate consisting of a material having electrical insulating properties, said anode being arranged in contact with one side of said discharge shielding plate, and said focusing electrode being arranged in contact with an other side opposing said one side of said discharge shielding plate;

a support plate consisting of a material having electrical insulating properties, fixed to the one side of said discharge shielding plate to have said anode therebetween; and a front cover consisting of a conductive material and having a window for projecting light, fixed to the other side of said discharge shielding plate to oppose said focusing electrode.

2. A tube according to claim 1, wherein said discharge shielding plate and said support plate are formed of a ceramic.

3. A deuterium gas discharge tube comprising:

an envelope in which deuterium gas is filled;

a thermionic cathode accommodated in said envelope, for emitting thermoelectrons;

an anode accommodated in said envelope, for receiving the thermoelectrons emitted from said thermionic cathode;

a focusing electrode accommodated in said envelope and having a focusing opening for focusing a path of the thermoelectrons emitted from said thermionic cathode and moving toward said anode;

a discharge shielding plate consisting of a material having electrical insulating properties and having a through-hole formed with a larger inner diameter than that of said focusing opening as a passage of the thermoelectrons emitted from said thermionic cathode and moving toward said anode, said anode being arranged in contact with one opening side of said through-hole, and said focusing electrode being arranged in contact with an other opening side opposing said one opening side of said through-hole;

a support plate consisting of a material having electrical insulating properties, fixed to the one opening side of said through-hole of said discharge shielding plate to have said anode therebetween; and a front cover consisting of a conductive material and having a window for projecting light, fixed to the other opening side of said through-hole of said discharge shielding plate to oppose said focusing electrode.

4. A tube according to claim 3, wherein said discharge shielding plate and said support plate are formed of a ceramic.

5. A tube according to claim 3, wherein a notch having a direction of depth substantially perpendicular to an extending direction of said through-hole is formed in an inner wall of said through-hole around said extending direction of said through-hole.

6. A tube according to claim 5, wherein said notch is formed to expand from said inner wall of said through-hole toward an inside of said discharge shielding plate and shaped to have a section tapered substantially parallel to the extending direction of said through-hole.

7. A tube according to claim 5, wherein said notch is constituted by a first slit having a direction of depth substantially perpendicular to the extending direction of said through-hole and formed in said inner wall of said through-hole around said extending direction of said through-hole, and a second slit having a direction of depth substantially parallel to the extending direction of said through-hole and formed in an inner wall of said first slit around the extending direction of said through-hole.

8. A tube according to claim 3, wherein a side portion of said envelope is constituted as a light-projecting portion for extracting light on the basis of positive column light emission by arc discharge which occurs between said thermionic cathode and said anode.

9. A tube according to claim 8, wherein a bottom portion of said envelope is hermetically sealed by a stem through which a first lead pin for applying a bias to said focus electrode, a second lead pin for applying a bias to said anode, and a third lead pin and a fourth lead pin for applying a power to said thermionic cathode respectively extend.

10. A tube according to claim 9, wherein said support plate is shaped into a prism having a convex section, has a through-hole substantially perpendicularly extending through the convex section at a projections portion of the prism, and is held by said first lead pin; said first lead pin extending through said through-hole of said support plate; said discharge shielding plate is shaped into a prism having a convex section, has another through-hole substantially perpendicularly extending through the convex section at a projections portion of the prism, and is held by said third and fourth lead pins bent into a substantially L-shape; an electrode rod bent into a substantially L-shape extending through said another through-hole of said discharge shielding plate from a top portion side of said envelope having a distal end welded to one distal end of said third lead pin and another distal end fixed to a distal end of said fourth lead pin by said thermionic cathode.

11. A tube according to claim 10, wherein said focusing electrode is constituted by a plate-like intermediate portion having said focusing opening coaxially arranged with said through-hole of said discharge shielding plate and arranged in contact with said projections portion of said discharge shielding plate, a plate-like upper portion bent toward said discharge shielding plate at an upper end of said intermediate portion and welded to one distal end of said first lead pin, and a plate-like side wall portion bent toward said front cover at a side end of said intermediate portion and having a rectangular opening opposing said thermionic cathode, and held by said discharge shielding plate.

12. A tube according to claim 10, wherein said support plate has a groove having a concave section and extending toward a bottom portion side of said envelope and at least two projecting portions at a periphery of said groove, and said anode is shaped into a rectangular plate, fixed to a distal end of said second lead pin, and held by said second lead pin adjacent said two projecting portions of said support plate, said second lead pin being connected to a power supply for applying a bias voltage.

13. A tube according to claim 10, wherein said thermionic cathode has an upper electrode rod and a lower electrode rod respectively fixed at two ends of said thermionic cathode, and held by said electrode rod extending through said another through-hole of said discharge shielding plate and having the another distal end welded to said upper electrode rod and the fourth lead pin having the distal end welded to said lower electrode rod, said third and fourth lead pins being connected to a power supply for applying a bias voltage.

14. A tube according to claim 11, wherein said focusing electrode is further constituted by an opening limit plate arranged at a periphery of said focusing opening on an opposite side to said discharge shielding plate, bent toward said discharge shielding plate and having an opening coaxially arranged with said focusing opening, for limiting an opening diameter of said focusing opening.

15. A tube according to claim 11 wherein four through-holes are formed in each of said support plate, said discharge shielding plate, and said focusing electrode to be coaxially arranged and extend substantially parallel to an extending direction of said through-hole of said discharge shielding plate; said support plate, said discharge shielding plate, and said focusing electrode being integrally held by two pins bent into a substantially U-shape and extending through said respective four through-holes of said support plate, said discharge shielding plate, and said focusing electrode from said focusing electrode side.

16. A tube according to claim 10, wherein two through-holes are formed in each of two ends of said discharge shielding plate to extend substantially parallel to an extending direction of said through-hole of said discharge shielding plate and said front cover is bent at each of four portions to have a substantially U-shaped section, has said light projecting window coaxially arranged with said focusing opening to oppose said side portion of said envelope and two projections portions at each of two side portions, and is held such that said two projections portions at each of two side portions extend through said two through-holes formed in each of two ends of said discharge shielding plate.

17. A tube according to claim 11, wherein said side wall portion of said focusing electrode is in contact with an inner surface of said front cover, and a periphery of said thermionic cathode is surrounded by said focusing electrode and said front cover.

18. A tube according to claim 3, wherein a top portion of said envelope is constituted as a light-projecting portion for extracting light on the basis of positive column light emission by arc discharge which occurs between said thermionic cathode and said anode.

19. A tube according to claim 18, wherein a bottom portion of said envelope is hermetically sealed by a tip tube having a closed distal end and has a first lead pin and a second lead pin for applying a power to said thermionic cathode, a third lead pin for applying a bias to said focusing electrode, a fourth lead pin for supporting said discharge shielding plate, a fifth lead pin for applying a bias to said anode, and a sixth lead pin for supporting said support plate respectively extending through said bottom portion of said envelope.

20. A tube according to claims 19, wherein said support plate is shaped into a cylinder open toward said top portion of said envelope, has six through-holes at a bottom portion, and is held by said first to sixth lead pins extending through said six through-holes at the bottom portion, said discharge shielding plate is shaped into a cylinder open toward said top portion of said envelope and having substantially a same outer diameter as that of said support plate, has four through-holes at a bottom portion to be arranged on a side wall portion of said support plate and coaxially arranged with said support plate.

21. A tube according to claim 20, wherein said focusing electrode is constituted by a substantially circular plate-like opening limit plate arranged at a periphery of an opening of said through-hole of said discharge shielding plate on an opposite side to said anode, bent toward said support plate, and having said focusing opening, coaxially arranged with said through-hole of said discharge shielding plate, for limiting an opening diameter of said through-hole of said discharge shielding plate, and a rectangular plate-like discharge straightening plate interposed between said opening limit plate and said thermionic cathode, welded to a peripheral portion of said opening limit plate, the opening limit plate fixed on an inner surface of said bottom portion of said discharge shielding plate, and is electrically connected to said third lead pin, said third lead pin being connected to a power supply for applying a bias voltage.

22. A tube according to claim 20, wherein said discharge shielding plate has a cylindrical projecting portion extending from a periphery of said through-hole of said discharge shielding plate toward said support plate, and said anode is arranged on an inner surface of a bottom portion of said support plate, fixed in contact with said projections portion of said discharge shielding plate, and is electrically connected to said fifth lead pin, said fifth lead pin being connected to a power supply for applying a bias voltage.

23. A tube according to claim 21, wherein said thermionic cathode is arranged closer to said top portion of said envelope than said discharge straightening plate and held such that said first and second lead pins are welded to two ends of electrode rods connected to said thermionic cathode, said first and second lead pins being connected to a power supply for applying a bias voltage.

24. A tube according to claim 20, wherein said front cover is shaped into a cylinder open toward said bottom portion of said envelope and having substantially the same outer diameter as that of said discharge shielding plate, has said light projecting window coaxially arranged with said focusing opening to oppose said top portion of said envelope, and arranged on a side wall portion of said discharge shielding plate.

* * * * *